US011623450B2

(12) United States Patent
McCourt et al.

(10) Patent No.: US 11,623,450 B2
(45) Date of Patent: Apr. 11, 2023

(54) OUTPUT MECHANISM FOR A FLUID CONTAINER

(71) Applicant: Hewlett-Packard Development Company, L.P., Spring, TX (US)

(72) Inventors: Zachary McCourt, Corvallis, OR (US); William J. Edwards, Corvallis, OR (US); James Dewey, Corvallis, OR (US); David M. Hagen, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/763,893

(22) PCT Filed: May 15, 2018

(86) PCT No.: PCT/US2018/032691

§ 371 (c)(1),
(2) Date: May 13, 2020

(87) PCT Pub. No.: WO2019/221701

PCT Pub. Date: Nov. 21, 2019

(65) Prior Publication Data

US 2020/0346460 A1 Nov. 5, 2020

(51) Int. Cl.
*B41J 2/175* (2006.01)

(52) U.S. Cl.
CPC ..... *B41J 2/17506* (2013.01); *B41J 2/17513* (2013.01); *B41J 2/17523* (2013.01); *B41J 2/17553* (2013.01); *B41J 2/17596* (2013.01)

(58) Field of Classification Search
CPC .... B41J 2/175; B41J 2/17503; B41J 2/17506; B41J 2/17513; B41J 2/17523; B41J 2/17553
See application file for complete search history.

(56) References Cited

U.S. PATENT DOCUMENTS 2,738,228 A 3/1956 Mack
4,162,501 A * 7/1979 Mitchell ..... B41J 2/17513 101/366

(Continued)

FOREIGN PATENT DOCUMENTS

CN 2328603 Y 7/1999
CN 106042651 A 10/2016

(Continued)

*Primary Examiner* — Anh T Vo
(74) *Attorney, Agent, or Firm* — Foley & Lardner LLP

(57) ABSTRACT

A fluid container that includes body that provides a fluid reservoir. Additionally, the fluid container can also include an outlet structure. The outlet structure can include a conduit that extends from an outlet of the fluid container to the fluid reservoir. Moreover, the fluid container can include an outlet barrier and an interior barrier. The outlet barrier can be positioned within the conduit of the outlet structure in proximity to the outlet of the fluid container. Additionally, the outlet barrier can be structured to receive an inlet extension of a container device. The interior barrier can be positioned within the conduit of the outlet structure in proximity to the fluid reservoir. Additionally, the interior barrier can be displaceable relative to the outlet structure by the inlet extension.

14 Claims, 3 Drawing Sheets

(56) References Cited

U.S. PATENT DOCUMENTS

| | | | | |
|---|---|---|---|---|
| 6,264,316 | B1 | 7/2001 | Chino | |
| 6,296,353 | B1 * | 10/2001 | Thielman | B41J 2/17503 347/85 |
| 6,695,170 | B2 | 2/2004 | Moretti | |
| 6,786,581 | B1 * | 9/2004 | Shinada | B41J 2/175 347/86 |
| 7,178,910 | B2 * | 2/2007 | Suzuki | B41J 2/175 347/85 |
| 7,294,308 | B2 | 11/2007 | Kacian et al. | |
| 7,334,889 | B2 * | 2/2008 | Sasaki | B41J 2/17513 347/86 |
| 8,070,014 | B2 | 12/2011 | Wisniewski | |
| 8,109,236 | B2 | 2/2012 | Brodowski et al. | |
| 8,556,123 | B2 | 10/2013 | Py et al. | |
| 9,309,981 | B2 | 4/2016 | Porterfield et al. | |
| 9,738,079 | B2 * | 8/2017 | Matsushita | B41J 2/175 |
| 2002/0084596 | A1 | 7/2002 | Michele et al. | |
| 2005/0146577 | A1 | 7/2005 | Sasaki et al. | |
| 2007/0171263 | A1 | 7/2007 | Inoue et al. | |

FOREIGN PATENT DOCUMENTS

| | | | |
|---|---|---|---|
| CN | 206151526 | U | 5/2017 |
| CN | 106804193 | A | 6/2017 |
| CN | 107303759 | A | 10/2017 |
| EP | 1016533 | B3 | 8/2011 |
| EP | 2465685 | B1 | 5/2014 |
| JP | 2004255890 | A | 9/2004 |
| JP | 2016203404 | A | 12/2016 |
| WO | WO-2015079547 | A1 | 6/2015 |

* cited by examiner

OUTPUT MECHANISM FOR A FLUID CONTAINER

BACKGROUND

Fluid ejection devices can include fluid storage components. In some examples, the fluid storage components can store ink. In other examples, these fluid storage components can store toner. In such examples, the fluid storage components can be refillable.

BRIEF DESCRIPTION OF THE DRAWINGS

The disclosure herein is illustrated by way of example, and not by way of limitation, in the figures of the accompanying drawings in which like reference numerals refer to similar elements, and in which.

Figure 1A:
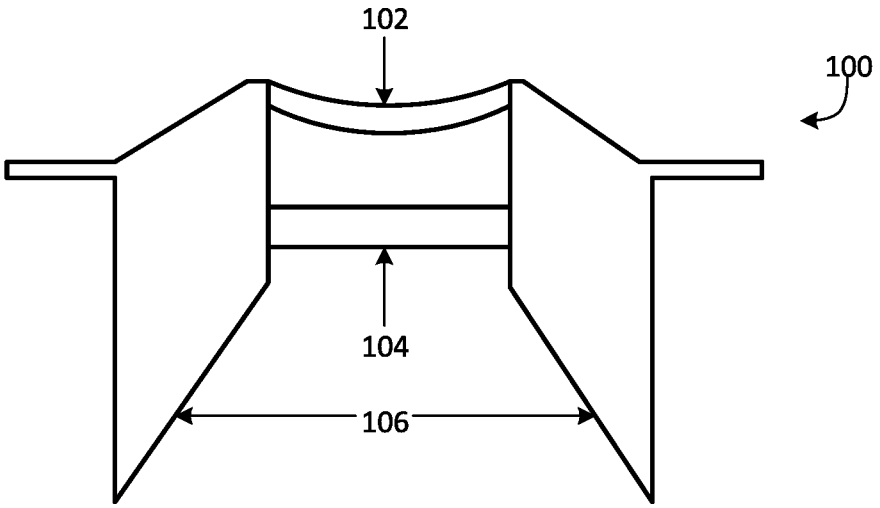
FIG. 1A illustrates a sectional view of an example outlet structure assembly for a fluid container.

Throughout the drawings, identical reference numbers designate similar, but not necessarily identical elements. The figures are not necessarily to scale, and the size of some parts may be exaggerated to more clearly illustrate the example shown. Moreover, the drawings provide examples and/or implementations consistent with the description. However, the description is not limited to the examples and/or implementations provided in the drawings.

DETAILED DESCRIPTION

Examples provide for a fluid container with an outlet structure assembly that can alleviate or prevent spillage of fluid (e.g., ink or toner) during the transfer of fluid from the fluid container to a receiving container of a fluid ejection device. In some examples, the outlet structure assembly can include a conduit that extends from a retention structure of the fluid container. Additionally, the outlet structure assembly can be structured to provide a controlled release of fluid that is in the retention structure of the fluid container. In various examples, the outlet structure assembly can also include an interior barrier that can preclude fluid from the retention structure from reaching the release location. In such examples, the outlet structure assembly can be dimensioned to receive an extension or interconnector from a fluid ejection device that engages and releases the interior barrier into the retention structure. The interior barrier can be buoyant as to cause the interior barrier to travel away from the extension and not block a mouth of the extension, when the extension releases the interior barrier into the retention structure. That way the extension can enter and access the fluids stored in the retention structure to obtain the fluid without the need for the interior barrier to be removed before engagement between the extension and the fluid container.

Examples as described recognize that an outlet structure assembly for a fluid container can enable the fluid container to engage with fluid ejection device (e.g., a printer device) without the need to remove the interior barrier first. Current implementations for conventional fluid containers usually include a seal fixed to the outside lip of an outlet of the conventional fluid container. As such, the conventional fluid container requires that the seal be removed prior to transferring the fluids from the fluid container to the receiving container. Additionally, among other benefits, examples as described recognize that the pressure in the fluid container with the outlet structure assembly can increase (e.g., due to changing altitudes or a change in temperature). In such examples, the outlet structure assembly can enable the fluid container to vent any excess pressure in the fluid container into the receiving container, when the fluid container with the outlet structure assembly engages with the receiving container.

System Description

FIG. 1A illustrates a sectional view of an example outlet structure assembly for a fluid container. As illustrated in FIG. 1A, outlet structure assembly 100 can include outlet barrier 102, interior barrier 104, and outlet structure 106 to alleviate and prevent fluids spilling from a fluid container during the transfer of fluids from the fluid container to a receiving container. As herein described, any fluid (e.g., ink), can pass through outlet structure 106.

As illustrated in FIG. 1A, outlet structure 106 can include a conduit. In some examples, outlet structure 106 can be dimensioned to fit into a fluid container that has a body that provides a fluid reservoir. For example, the fluid container can include a conduit (e.g., a neck of a bottle) with an outlet that outlet structure 106 can fit into. In such an example, the conduit of outlet structure 106 can extend from the outlet of the conduit of the fluid container to the fluid reservoir of the fluid container. That way, fluid from the fluid reservoir can pass through the conduit of outlet structure 106.

As shown in FIG. 1A, outlet structure 106 can include outlet barrier 102. In examples where outlet structure 106 is in a conduit of a fluid container, outlet barrier 102 can be positioned within the conduit of outlet structure 106 near or proximate to an outlet of the conduit of the fluid container. In some examples, outlet barrier 102 can be structured to receive an inlet extension from a container device. According to examples, the container device includes any device that is structured to receive, retain and use a fluid (e.g., ink). In such examples, outlet barrier 102 can be formed from a flexible polymer. For example, the outlet barrier 102 can be a slit silicone valve.

Additionally, as shown in FIG. 1A, outlet structure 106 can include interior barrier 104 (e.g., a seal). In examples where outlet structure 106 is in a conduit of a fluid container, interior barrier 104 can be positioned within the conduit of outlet structure 106 such that interior barrier 104 is proximate or near a fluid reservoir of the fluid container. In such examples, interior barrier 104 can prevent fluid passing through outlet structure 106 from reaching outlet barrier 102. In some example, as interior barrier 104 can be axially spaced apart from outlet barrier 102. In some examples, interior barrier 104 can be formed from a polypropylene material. In other examples, interior barrier 104 can be formed from a plastic material.

As described, outlet structure assembly 100 can prevent fluid in a fluid container (e.g., a supply ink bottle) from spilling during the transfer of the fluid from the fluid container to a container device. For example, the fluid container can be a supply ink bottle that includes a body that holds or includes a fluid reservoir, and a neck that provides an outlet for fluid stored in the fluid reservoir. In such a configuration, outlet structure assembly 100 can be positioned within the neck of the bottle such that outlet structure 106 extends from the fluid reservoir of the fluid bottle to an outlet of the neck. Additionally, interior barrier 104 can prevent the fluid from reaching outlet barrier 102. Moreover, outlet barrier 102 can provide a controlled release of the fluid in fluid reservoir if interior barrier 104 is released from outlet structure 106 and an inlet extension from a container device penetrates outlet barrier 102 and displaces interior barrier 104.

In some examples, outlet structure assembly 100 can include additional structures to retain interior barrier 104 in outlet structure 106. For example, an interior wall of a conduit of outlet structure 106 can be shaped to include or be coupled to a retaining feature. Additionally, interior barrier 104 can include a retaining element. In such an example, the retaining element of interior barrier 104 can lock into position when engaged with the retaining feature of outlet structure 106. In some examples, an interior wall of a conduit of outlet structure 106 can be shaped to include or be coupled to a retaining feature.

In some examples, a retaining feature can form an overhang structure with an undercut feature and a retaining element of interior barrier 104 can include a beaded element. Additionally, the beaded element of interior barrier 104 can engage and lock into the undercut feature of the overhang structure. In other examples, the retaining feature can form an overhang structure and the retaining element of the interior barrier 104 can include a rib structure. In such examples, the rib structure of interior barrier 104 can engage with the overhang structure of the retaining feature (e.g., by positioning the rib structure of interior barrier 104 past the overhanging structure of outlet structure 106). In other examples, the retaining feature can include a hinging mechanism that allows interior barrier 104 to be coupled to the wall and still be displaceable from its original position. For example, in examples where an interconnector or an inlet from a fluid ejection device that engages and releases interior barrier 106, interior barrier 106 can be moved from its original position such that interior barrier 106 does not block a mouth of the inlet or interconnector. As such, the inlet or interconnector can obtain fluid from the fluid container. In yet other examples, outlet structure 106 can include a retaining feature and interior barrier 104 can include a beaded element.

In some examples, interior barrier 104 can be formed from a material that is impermeable to prevent fluid from passing through outlet structure 106 from reaching outlet barrier 102. Additionally, in some examples, the material that interior barrier 104 can be formed from can also be buoyant in a fluid of a fluid container. Examples of such materials include, plastic materials, LDPE (low-density polyethylene) materials, polypropylene materials, etc.

Figure 1B:
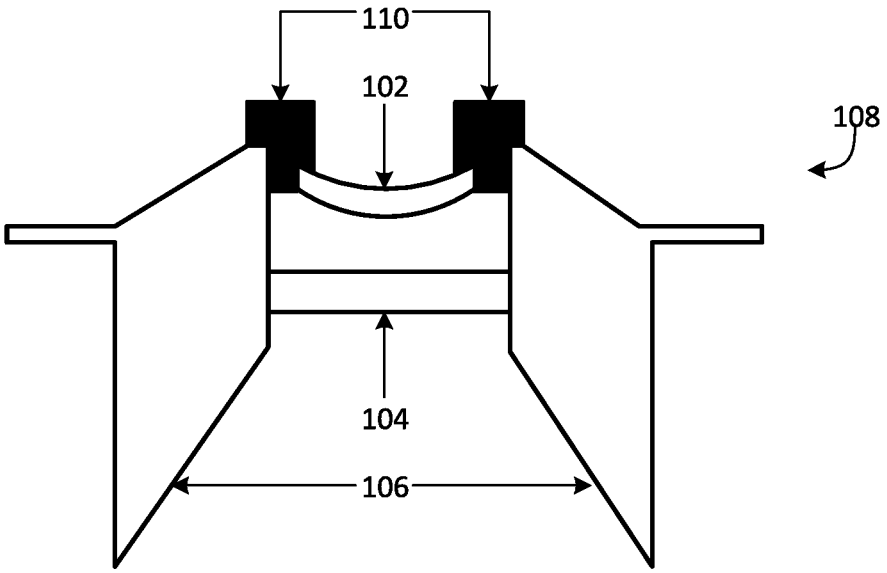
FIG. 1B illustrates a sectional view of an example outlet structure assembly with a retaining structure.

In some examples, outlet structure assembly 100 can include additional structures to retain outlet barrier 102. FIG. 1B, illustrates a sectional view of an example outlet structure assembly with a retaining structure. Similar to outlet structure assembly 100 of FIG. 1A, outlet structure assembly 108 can include outlet barrier 102, interior barrier 104, and outlet structure 106. Additionally, outlet structure assembly 108 can include retaining structure 110 to retain outlet barrier 102. In some examples, retaining structure 110 can include a retaining ring positioned at the release location of outlet structure 106 to retain outlet barrier 102.

Figure 1C:
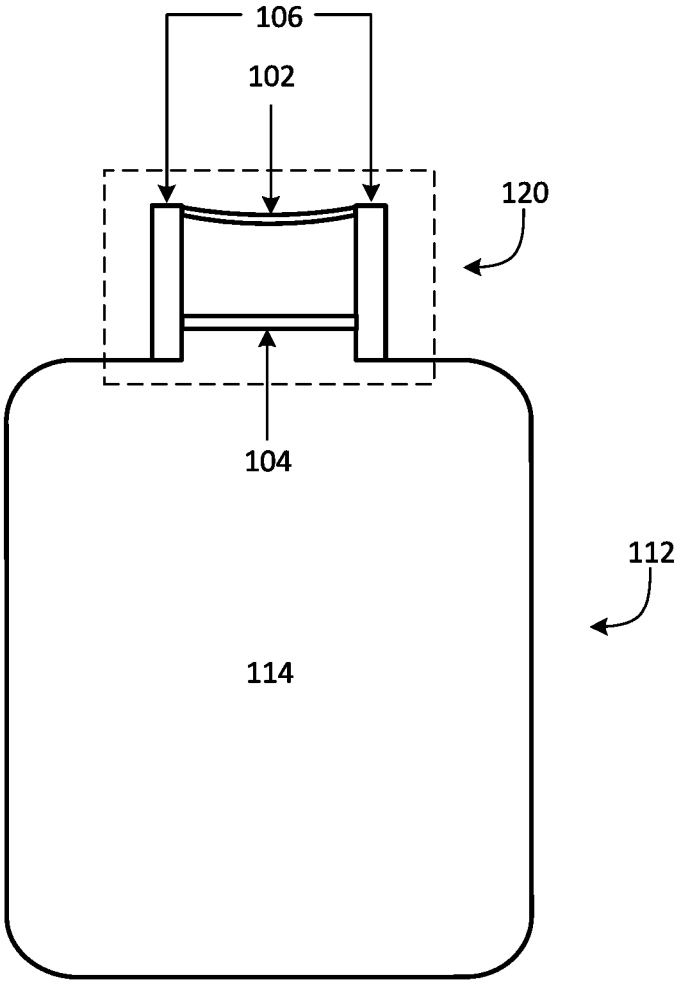
FIG. 1C illustrates a sectional view of an example outlet structure assembly within a fluid container.

In some examples, an outlet structure assembly may include the conduit of a fluid container. For example, as illustrated in FIG. 1C, fluid container 112 can include outlet structure 106. As shown in FIG. 1C, outlet structure 106 can be the conduit of the fluid container. That way, outlet barrier 102 and interior barrier 104 can be positioned within the conduit of the fluid container (e.g., being coupled to the interior walls of the conduit of the fluid container) making outlet structure assembly 108 a part of fluid container 112. For examples, as shown in FIG. 1C, outlet barrier 102 can be positioned proximate to or near to the outlet of the conduit of fluid container 112. Additionally, interior barrier 104 can be position near to or proximate to a fluid reservoir of body 114 of fluid container 112. In some examples, similar to FIG. 1B, the conduit of the fluid container can include retaining structures to retain outlet barrier 102 near to or proximate to the outlet of the conduit of the fluid container. In other examples, the conduit of the fluid container can include a retaining feature proximate or near to an outlet of the conduit. Additionally, interior barrier 104 can include a retaining element. That way, in such examples, the retaining element of interior barrier 104 can lock into position when engaged with the retaining feature of the conduit of the fluid container.

In some examples, an interior wall of a conduit of outlet structure 106 can be shaped to include or be coupled to a retaining feature. In such examples, the retaining element of interior barrier 104 can include a beaded element that can engage and lock into the undercut feature of the overhang structure. In other examples, interior wall of a conduit of outlet structure 106 can be shaped to include or be coupled to a retaining feature that can be formed to an overhang structure. In such examples, the retaining element of interior barrier 104 can include a rib structure that can engage with the overhang structure of the retaining feature (e.g., by positioning the rib structure of interior barrier 104 past the overhanging structure of the conduit of the fluid container). In yet other other examples, the retaining feature can include a hinging mechanism that allows interior barrier 104 to be partially released from the conduit of the fluid container. For example, in examples where an interconnector or an inlet from a fluid ejection device that engages and releases interior barrier 106, interior barrier 106 can be moved from its original position such that interior barrier 106 does not block a mouth of the inlet or interconnector. As such, the inlet or interconnector can obtain fluid from the fluid container.

Figure 2A:
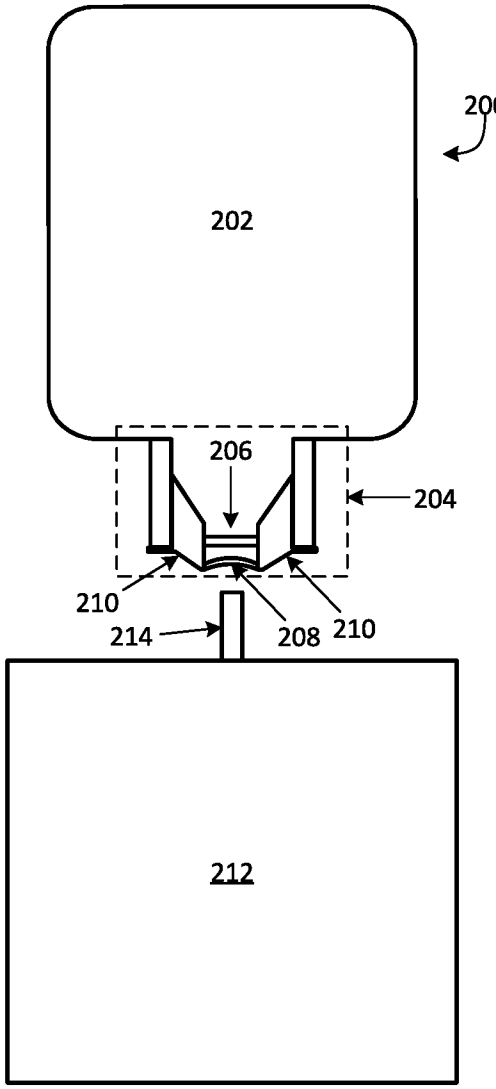
FIG. 2A illustrates a sectional view of an example fluid container with an outlet structure assembly before engagement with an example receiving container of a fluid ejection device.
Figure 2B:
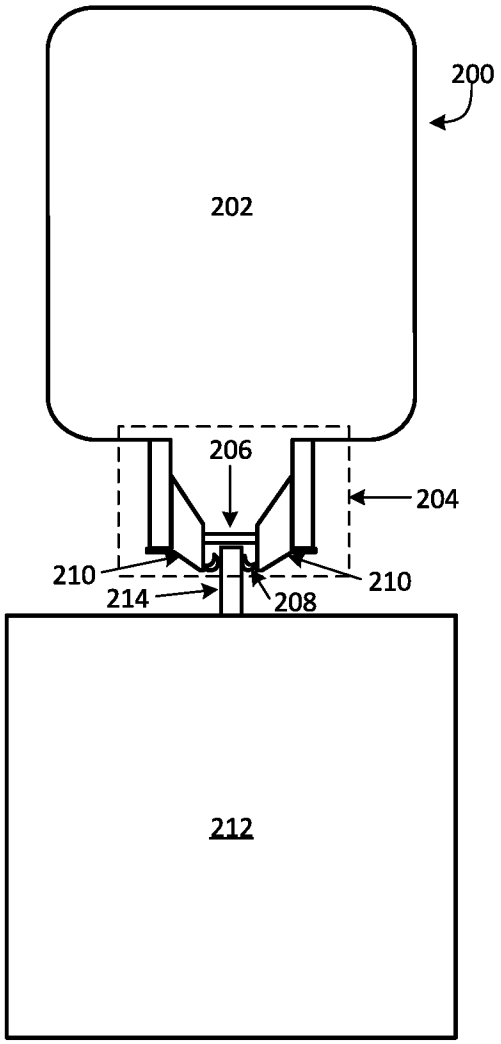
FIG. 2B illustrates a sectional view of an example fluid container with an outlet structure assembly engaging with an example receiving container of a fluid ejection device.
Figure 2C:
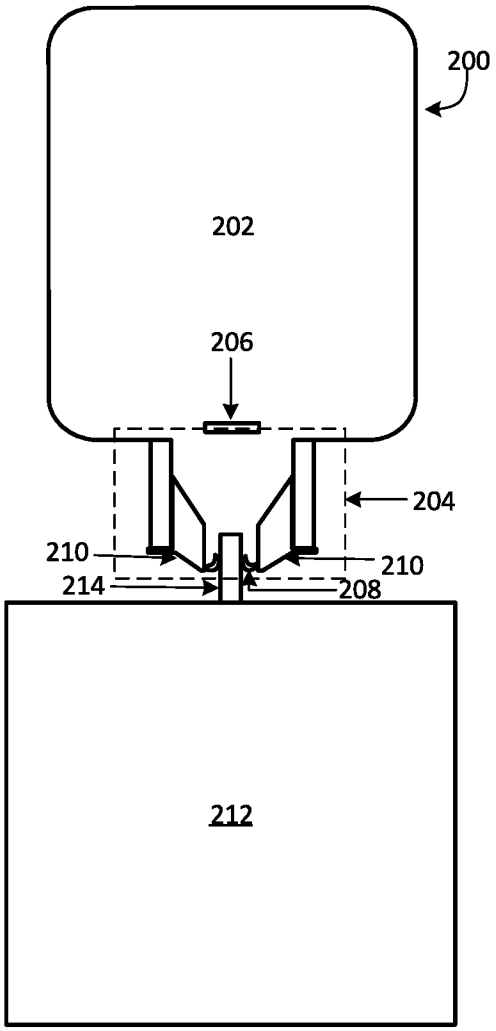
FIG. 2C illustrates a sectional view of an example receiving container releasing an interior barrier of an outlet structure assembly of a fluid container.

In some examples, a fluid container with an outlet structure assembly or inlet extension can engage with a container device, such as a fluid ejection device, to transfer the fluid in the fluid container into a receiving container of the fluid ejection device (e.g., a printer). Additionally, the outlet structure assembly can include an outlet barrier, an interior barrier and an outlet structure. In such examples, the fluid ejection device can obtain fluid from the fluid container through outlet structure assembly without first removing the interior barrier prior to engagement between the fluid container and the fluid ejection device. FIGS. 2A-2C, illustrates a sectional view of an example fluid container with an outlet structure assembly engaging with an example receiving container of a fluid ejection device. FIG. 2A, illustrates a sectional view of an example fluid container with an outlet structure assembly before engagement with an example receiving container of a fluid ejection device. FIG. 2B, illustrates a sectional view of an example fluid container with an outlet structure assembly engaging with an example receiving container of a fluid ejection device. FIG. 2C illustrates a sectional view of an example receiving container releasing an interior barrier of an outlet structure assembly of a fluid container.

FIG. 2A, illustrates a sectional view of an example fluid container with an outlet structure assembly before engagement with an example receiving container of a fluid ejection device. As illustrated in FIG. 2A, fluid container 200 includes body 202 that provides a fluid reservoir. Additionally, fluid container 200 includes outlet structure assembly 204 that is positioned at the opening (e.g., the neck) of fluid container 200. Similar to outlet structure assembly of 100 of FIG. 1A, outlet structure assembly 204 can include outlet barrier 208, interior barrier 206 and outlet structure 210. Moreover, receiving container 212 can include extension 214. Inlet mechanism as shown as extension 214 can be configured to open outlet barrier 208 when extension 214 engages (e.g., punctures or penetrates) with outlet barrier 208.

In some examples, outlet barrier 208 can be dimensioned to receive extension 214. FIG. 2B, illustrates an example cross-sectional view of an example fluid container with an outlet structure assembly engaging with an example receiving container of a fluid ejection device. In some examples, as illustrated in FIG. 2B, outlet barrier 208 can be structured to be separated or opened when penetrated by extension 214 and close when extension 214 is removed. In some examples, outlet barrier 208 can be formed from a flexible polymer (e.g., a slit silicone valve).

Extension 214 can release interior barrier 206 into body 202 to obtain fluid from fluid container 200. FIG. 2C illustrates a sectional view of an example receiving container releasing an interior barrier of an outlet structure assembly of a fluid container. As illustrated in FIG. 2C, extension 214, enters outlet structure assembly 204 through outlet barrier 208 and engages and release interior barrier 206. In some examples, extension 214 pushes against interior barrier 206 until interior barrier 206 is released into body 202 of fluid container 200. In such examples, interior barrier 206 can be formed from a material that is buoyant in the fluid stored in the fluid reservoir of the fluid container. That way, when extension 214 engages and releases interior barrier 206 from outlet structure 210, interior barrier 206 can enter the fluid reservoir and not obstruct fluid being obtained by receiving container 212. Examples of such materials that interior barrier 206 can be formed from include, plastic materials, LDPE (low-density polyethylene) materials, polypropylene materials, etc.

As described, extension 214 can obtain fluid from fluid container 200 without first removing interior barrier 206 prior to the engagement of fluid container 200 with outlet structure assembly 204. That way, outlet structure assembly 204 can alleviate spillage of fluid from fluid container 200 during the transfer of the fluid from fluid container 200 to receiving container 212 of a fluid ejection device.

Although specific examples have been illustrated and described herein, it will be appreciated by those of ordinary skill in the art that a variety of alternate and/or equivalent implementations may be substituted for the specific examples shown and described without departing from the scope of the disclosure. This application is intended to cover any adaptations or variations of the specific examples discussed herein.

What is claimed is:

1. An ink container comprising:

a body providing a fluid reservoir;

an outlet structure including a conduit that extends from an outlet of the ink container to the fluid reservoir;

an outlet barrier spanning the conduit of the outlet structure in proximity to the outlet of the ink container, the outlet barrier being structured to receive an inlet extension of a container device; and a seal positioned within the conduit of the outlet structure in proximity to the fluid reservoir, wherein the seal is formed from a plastic material that is buoyant in a fluid of the fluid reservoir, the seal being released from the outlet structure by insertion of the inlet extension such that the seal floats on the fluid in the fluid reservoir, thereby opening fluid flow from the fluid reservoir.

2. The ink container of claim 1, wherein a portion of the outlet structure is tapered.

3. The ink container of claim 2, wherein the outlet barrier is axially spaced apart from the seal along the conduit.

4. The ink container of claim 1, wherein the outlet structure includes a retaining feature and the seal including a retaining element, and wherein the seal is being retained by the retaining feature locking into position with the retaining element.

5. An ink container comprising:

a body providing a fluid reservoir;

an outlet structure including a conduit that extends from an outlet of the ink container to the fluid reservoir;

an outlet barrier positioned within the conduit of the outlet structure in proximity to the outlet of the ink container, the outlet barrier being structured to receive an inlet extension of a container device; and a seal positioned within the conduit of the outlet structure in proximity to the fluid reservoir, the seal being detachable from the outlet structure by the inlet extension to open fluid flow from the fluid reservoir, wherein the seal is formed from a polypropylene material that is buoyant in a fluid of the fluid reservoir.

6. A fluid container comprising:

a body providing a fluid reservoir;

an outlet structure including a conduit that extends from an outlet of the fluid container to the fluid reservoir;

an outlet barrier positioned within the conduit of the outlet structure in proximity to the outlet of the fluid container, the outlet barrier being structured to receive an inlet extension of a container device; and an interior barrier that is buoyant in a fluid of the fluid reservoir, the interior barrier originally being positioned within the conduit of the outlet structure proximate the fluid reservoir, and being releasable relative to the outlet structure by the inlet extension to open fluid flow from the fluid reservoir.

7. The fluid container of claim 6, wherein a portion of the outlet structure is tapered.

8. The fluid container of claim 7, wherein the outlet barrier is axially spaced apart from the interior barrier along the conduit.

9. The fluid container of claim 7, wherein the outlet structure includes a retaining ring to retain the outlet barrier.

10. The fluid container of claim 7, wherein the outlet barrier is formed from a flexible polymer.

11. The fluid container of claim 6, wherein the outlet structure includes a retaining feature and the interior barrier includes a retaining element, and wherein the interior barrier is being retained by the retaining feature locking into position with the retaining element.

12. The fluid container of claim 11, wherein the retaining feature forms an overhang structure.

13. The fluid container of claim 6, wherein the interior barrier is formed from a polypropylene material that is buoyant in a fluid of the fluid reservoir.

14. The fluid container of claim 6, wherein the interior barrier is formed from a plastic material that is buoyant in a fluid of the fluid reservoir.

* * * * *